US006069642A

United States Patent [19]

Isobe

[11] Patent Number: 6,069,642

[45] Date of Patent: May 30, 2000

[54] CASSETTE FOR HOLDING INK RIBBON AND PRINT PAPER THEREIN AND PRINTER INCORPORATING THE CASSETTE THEREIN

[75] Inventor: Minoru Isobe, Tokyo, Japan

[73] Assignee: Oki Data Corporation, Tokyo, Japan

[21] Appl. No.: 09/412,638

[22] Filed: Oct. 5, 1999

[30] Foreign Application Priority Data

Oct. 6, 1998 [JP] Japan ..... 10-284075

[51] Int. Cl.[7] ..... B41J 2/325; B41J 32/00

[52] U.S. Cl. ..... 347/176; 347/214

[58] Field of Search ..... 347/171, 172, 347/174, 176, 214, 218; 400/120.04, 120.02, 120.01, 207, 208, 208.1

[56] References Cited

U.S. PATENT DOCUMENTS 4,869,606 9/1989 Lehmann et al. ..... 347/214

4,914,452 4/1990 Fukawa ..... 347/214

*Primary Examiner*—Huan Tran

*Attorney, Agent, or Firm*—Rabin & Champagne, PC

[57] ABSTRACT

An ink ribbon-print paper cassette is used in a thermal printer. A paper tray accommodates a stack of single sheets of print paper. The paper tray has an opening through which the print paper is fed into a paper path on a sheet-by-sheet basis. An ink ribbon for thermal printing runs over a thermal head located adjacent the paper tray. A housing accommodates the paper tray, thermal head, and ink ribbon therein. When the cassette is loaded into the thermal printer, the outer surface of the cassette and an inner wall of the thermal printer cooperate to form a paper path therebetween through which each of the sheets of print paper is advanced from the paper tray to the thermal head.

13 Claims, 8 Drawing Sheets

CASSETTE FOR HOLDING INK RIBBON AND PRINT PAPER THEREIN AND PRINTER INCORPORATING THE CASSETTE THEREIN

FIELD OF THE INVENTION

The present invention relates to a cassette that holds consumable items such as print papers and ink ribbon, and to a thermal printer which incorporates the cassette.

DESCRIPTION OF THE RELATED ART

With a conventional thermal printer, consumable items such as paper and ink ribbon are accommodated in a cassette. The cassette is loaded to a printing mechanism. Holding a stack of print paper and an ink ribbon in an integral design allows easy handling of consumable items. One such type of printer is disclosed in Japanese Patent No. 5-52275. According to this patent, a paper-accommodating space and an ink ribbon accommodating space lie in the same plane for thin construction. However, the thin construction makes the cassette longer. The take-up roller and supply roller are separated a certain minimum distance from each other so that a thermal head is received between the take-up roller and supply roller. Thus, the total length of the cassette cannot be small.

Laid-open Japanese Patent No. 2-44085 discloses a cassette having a small space that accommodates an ink ribbon. The supply roller and take-up roller are closely located to each other and the take-up roller is pulled out of the cassette just before the printing is started. Thus, the construction requires a mechanism for loading and unloading the take-up roller, making the construction of the printer more complex.

The take-up roller and supply roller should be closely disposed as long as the thermal head can operate normally, thereby minimizing the space for the ink ribbon to implement a cassette of thin construction and a miniaturized printer accordingly. For monochrome printing, the paper can be discharged shortly after the thermal head has printed an image on the print paper. However, for color printing, the print paper is required to advance back and forth relative to the thermal head in order to print images of different colors in superposition. If a part of the print paper is exposed, there is a chance of the print paper receiving inadvertent external forces. For this reason, a paper path of about half the total length of the print paper should be provided downstream of the thermal head. This requirement places limitations on miniaturizing printers having print paper accommodating section and ink ribbon-accommodating section.

SUMMARY OF THE INVENTION

An object of the invention is to provide a miniaturized cassette.

Another object of the invention is to provide a miniaturized printer.

An ink ribbon-print paper cassette is used in a thermal printer. A paper tray accommodates a stack of single sheets of print paper. The paper tray has an opening through which the print paper is fed into a paper path on a sheet-by-sheet basis. An ink ribbon for thermal printing runs over a thermal head located adjacent the paper tray. A housing accommodates the paper tray, thermal head, and ink ribbon therein. When the cassette is loaded into the thermal printer, the outer surface of the cassette and an inner wall of the thermal printer cooperate to form a paper path therebetween through which each of the sheets of print paper is advanced from the paper tray to the thermal head.

A take-up roller and a supply roller are disposed with the thermal head therebetween. The ink ribbon is unreeled from the supply roller to the take-up roller. The ink ribbon may be disposed with the paper tray therebetween.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRPTION OF THE DRAWINGS

The present invention will become more fully understood from the detailed description given hereinbelow and the accompanying drawings which are given by way of illustration only, and thus do not necessarily limit the scope of the present invention, and wherein.

DESCRIPTION OF THE INVENTION

Figure 1:
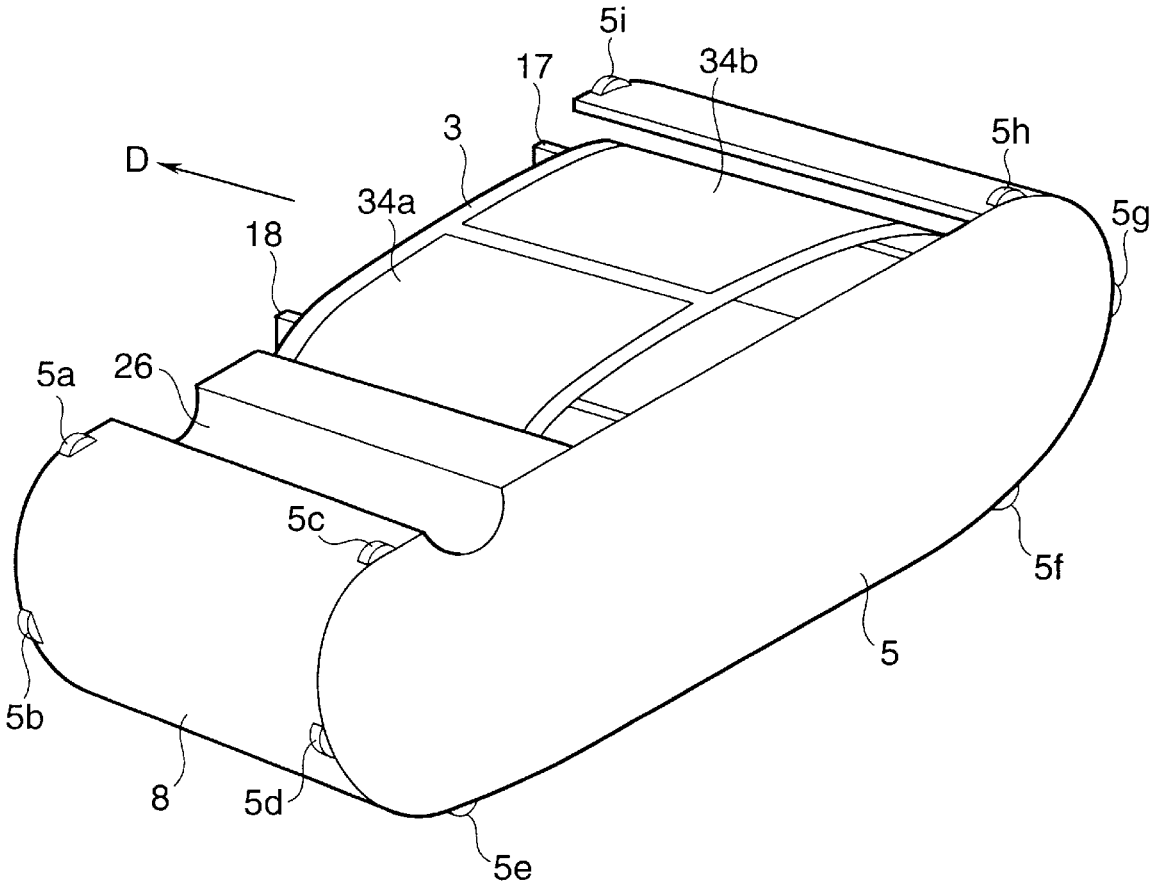
FIG. 1 is a perspective view of the cassette according to a first embodiment.

Preferred embodiments of the present invention will be described in detail with reference to the accompanying drawings. Elements of the same construction have been given the same reference numerals throughout the embodiments and the description thereof is omitted.

First Embodiment

<Construction>

FIG. 1 is a perspective view of an ink ribbon-print paper cassette 5 according to a first embodiment.

Referring to FIG. 1, the cassette 5 has a body having opposed generally flat upper and lower surfaces and opposed short curved surfaces 8 that project outwardly of the body. The body has a plurality of short projections 5*a*–5*i* projecting outwardly from the body. The body has a recess 26 formed in its outer surface. The recess 26 receives a later described feed roller 22*b* therein. The ink ribbon 3 is an ink ribbon used for color printing and includes a plurality of color ink regions (only regions 34*a* and 34*b* are shown) that have substantially the same width as the print paper 4. When the cassette 5 is inserted into a thermal printer 1 (FIG. 2) in a direction shown by arrow D, the projections 5*a*–5*i* engage mating recesses, not shown, formed in the cassette receiving section so that the cassette is firmly held in the cassette receiving section.

Figure 2:
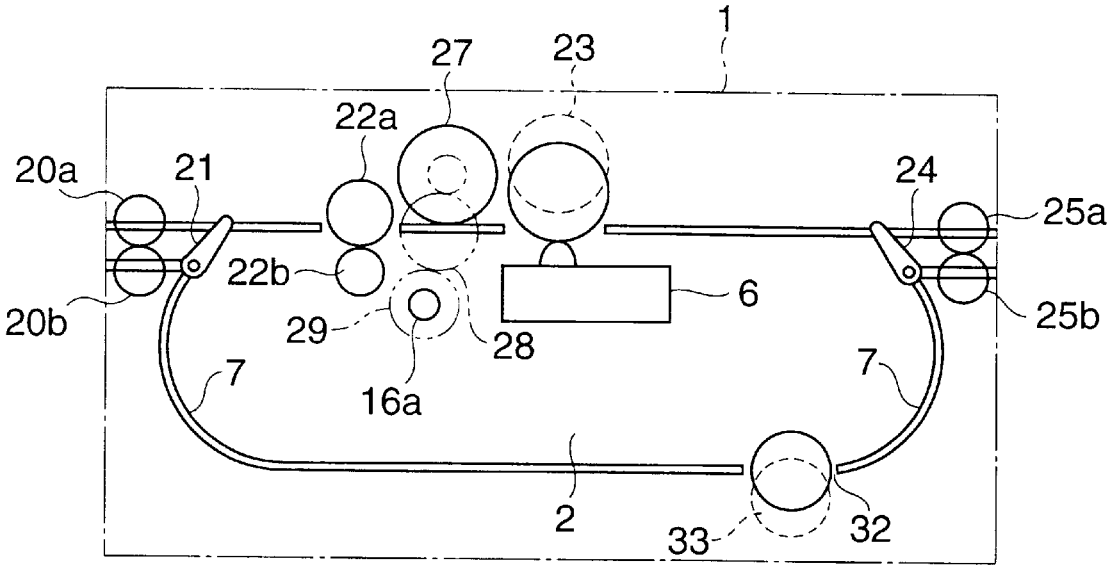
FIG. 2 illustrates a cassette receiving section of the first embodiment before the cassette is loaded into the printer.

FIG. 2 illustrates a cassette receiving section 2 before the cassette 5 is loaded into the printer 1.

Figure 3:
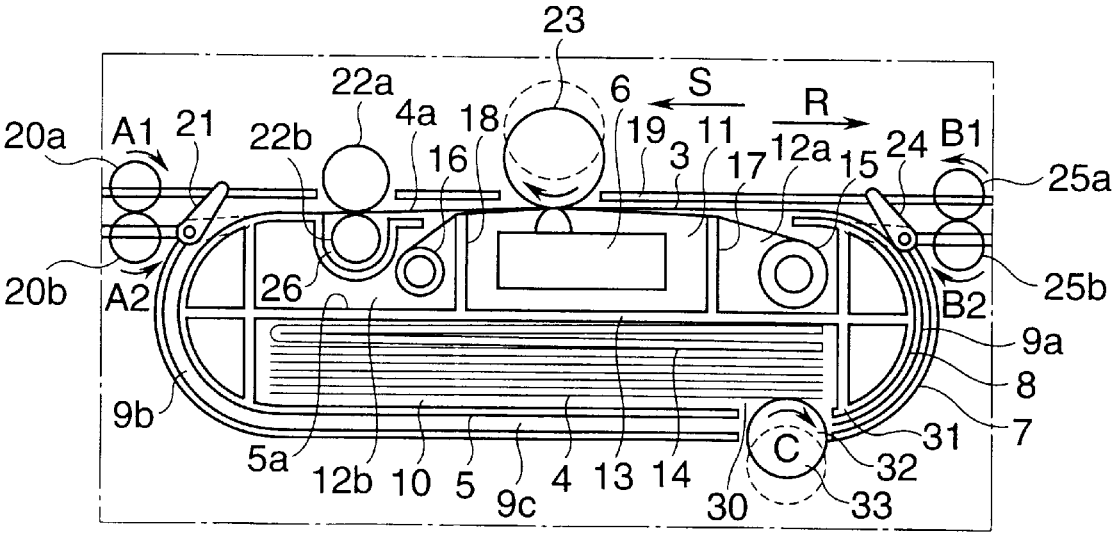
FIG. 3 illustrates a general construction of a printer according to the first embodiment of the invention.

FIG. 3 illustrates a general construction of the printer 1 according to the first embodiment.

Referring to FIGS. 2 and 3, the thermal printer 1 has a cassette-receiving section 2 into which the cassette 5 incorporating the ink ribbon 3 and a stack of print paper 4 is loaded. The cassette receiving section 2 incorporates a thermal head 6. The cassette 5 is received in the cassette receiving section 2 such that the ink ribbon 3 is between the thermal head 6 and a platen 23. The cassette receiving section 2 has opposed curved walls 7. Upon loading the cassette 5 into the cassette receiving section 2, paper paths 9*a* and 9*b* are defined between the curved walls 7 and the outer surfaces 8 of a curved body of the cassette 5, and a horizontal paper path 19 is defined over the cassette 5.

The printer 1 incorporates feed-out rollers 20*a* and 20*b*, switching blade 21, feed rollers 22*a* and 22*b*, platen roller 23, switching blade 24, and feed-out rollers 25*a* and 25*b*. The feed-out rollers 20*a* and 20*b* rotate in directions shown by arrows A1 and A2 while the feed-out rollers 25*a* and 25*b* rotate in directions shown by arrows B1 and B2. The switching blades 21 and 24 are switched between the solid line positions and the dotted line positions by solenoids, not shown. A motor, not shown, drives the feed rollers 22*a* and 22*b* in rotation either in forward directions or in reverse directions, depending on the direction of travel of the print paper. The cassette 5 is formed with the recess 26 (FIG. 1) therein that receives the feed roller 22*b* therein.

The platen roller 23 is movable between the solid line position and the dotted line position, and is rotated either in a forward direction shown by arrow H or in a reverse direction depending on the direction of travel of the print paper. When the platen roller 23 is at the solid line position, the print paper 4 is sandwiched between the platen roller 23 and the thermal head 6 such that the print paper 4 is pressed against the thermal head 6. The platen roller 23 can be moved by a planetary gear train. Alternatively, rotating arms that hold the shaft of the platen roller 23 may be moved, thereby moving the platen roller 23 between the dotted line position and solid line position.

When a take-up shaft 16*a* of the take-up roller 16 is rotated, the take-up roller 16 takes up the ink ribbon 3. The printer 1 has a motor 27 and a gear 28 that is in mesh with a motor gear of the motor 27 as shown in FIG. 2. The gear 28 is in mesh with a gear 29 mounted to the take-up shaft 16*a*. Thus, upon loading the cassette 5 into the printer 1, the take-up roller 16 becomes ready to rotate.

The cassette 5 includes a paper tray 10, a thermal head receiving section 11, and ink ribbon receiving sections 12*a* and 12*b*. The paper tray 10 accommodates a stack of the print paper 4 therein. The paper tray 10 has a flat spring 14 between the print paper 4 and a middle wall 13. The flat spring 14 urges the print paper 4 downward against a feed roller 33. The thermal head receiving section 11 and ink ribbon receiving sections 12*a* and 12*b* are on the side of the middle wall 13 remote from the paper tray 10. The ink ribbon 3 extends across the ink ribbon receiving sections 12*a* and 12*b* through the thermal head receiving section 11, over a distance somewhat shorter than the length of the print paper 4, i.e., the dimension of the print paper in a direction of travel of the print paper. The ink ribbon receiving section 12*a* accommodates a supply roller 15 and the ink ribbon receiving section 12*b* accommodates a take-up roller 16. Ribbon guides 17 and 18 rise upward defining the ink ribbon receiving section 12*a* and 12*b*, respectively. The ribbon guides 17 and 18 also define the thermal head receiving section 11 therebetween.

The cassette 5 is formed with a paper-feed opening 30 at a lower end thereof through which the print paper 4 is advanced on a page-by-page basis from the paper tray 10 into the paper path 9*a*. The cassette receiving section 2 has an opening 32 that is aligned with the paper feeding opening 30. The feed roller 33 enters the opening 32 and is rotatable in the opening 32. The feed roller 33 is movable between the solid line position and the dotted line position. When the feed roller 33 is at the solid line position, the feed roller 33 is pressed against the print paper 4. When the cassette 5 is unloaded from the printer 1, the feed roller 33 is at the dotted line position. The feed roller 33 can be moved in a manner similar to the platen roller 23.

The length of the print paper 4 in a direction of travel of the print paper is longer than the paper path which runs from the feed roller 33, through the curved paper path 9*a* and the paper path 19, to the feed rollers 22*a* and 22*b*. The length of the print paper 4 in the direction of travel of the print paper 4 is shorter than a paper path that runs from the feed rollers 22*a* and 22*b* through the curved paper path 9*b* to the feed roller 33.

<Operation>

The operation of the printer according to the first embodiment will be described with respect to color printing.

The printer 1 can operate either on batteries or AC current.

The cassette 5 is first loaded into the printer 1.

The platen roller 23 and feed roller 33 are at the dotted line positions as shown in FIG. 3. When the cassette 5 has been loaded into the cassette receiving section 2, the thermal head 6 is in position in the thermal head receiving section 11 and the feed roller 33 is at the solid line position where the feed roller 33 is in pressure contact with the bottom page 4*a* of the stack of print paper 4. The flat spring 14 urges the print paper 4 downward against the feed roller 33. The printing operation starts from this condition. The gear 29 mounted on the take-up shaft 16*a* of the take-up roller 16 becomes in mesh with the gear 28, so that the motor 27 can drive the take-up roller 16 in rotation.

The feed roller 33 is rotated in the direction shown by arrow C, so that the bottom page 4*a* of the print paper 4 is fed from the paper tray 11 into the paper path 9*a*. A separator 31 engages the print paper to ensure that only the bottom page 4*a* of the stack of print paper 4*a* is directed into the paper path 9*a*. The switching blade 24 is at the solid line position at this moment. Thus, the print paper 4*a* passes through the curved path 9*a* into the straight paper path 19 and reaches the feed rollers 22*a* and 22*b*. The print paper 4*a* continues to be advanced until the trailing end of the print paper 4*a* is released completely from the feed roller 33, then the print paper 4*a* stops. Then, the platen roller 23 moves to the solid line position to press the print paper 4*a* and ink ribbon 3 against the thermal head 6.

The feed rollers 22*a* and 22*b* are rotated and the thermal head 6 is driven to generate heat in accordance with print data. Heat is supplied to the ink region 34*a* of the first color to transfer the melted ink to the print paper 4*a*. The feed rollers 22*a* and 22*b* transport the print paper 4*a* while the switching blade 21 guides the print paper 4*a* through the curved paper path 9*b* into the lower paper path 9*c*. When an image of the first color has been printed on the print paper 4*a*, the feed rollers 22*a* and 22*b* halt. Subsequently, the platen roller 23 is moved to the dotted line position. At this moment, the trailing end of the print paper 4*a* is still sandwiched between the feed rollers 22*a* and 22*b*.

Then, the feed rollers 22*a* and 22*b* are rotated in reverse directions, so that the print paper 4*a* is advanced in the opposite direction shown by arrow R and the trailing end of the print paper 4*a* enters the paper path 9*a*. While the print paper 4*a* is being advanced in the opposite direction shown by arrow R, the take-up roller 16 is driven to take up the ink ribbon 3 in order to set the ink region of the second color in position. When the print paper 4*a* has moved backward to a position where the beginning of the print region on the print paper 4*a* is at the thermal head 6, the feed rollers 22*a* and 22*b* are halted. At this moment, the trailing end of the print paper 4*a* has not reached the feed roller 33.

Then, the printing for the second color begins. Just as in the printing for the first color, the feed rollers 22*a* and 22*b* are rotated in the forward directions and the thermal head 6 is driven to generate heat in accordance with the print data for the second color. As the printing for the second color proceeds, the print paper 4*a* is guided to again enter the paper path 9*b*. The aforementioned printing process is carried out repetitively for different colored inks. Just before the printing of the final color is carried out, the switching blade 21 is shifted to the dotted line position to guide the print paper 4*a* to the exit. If the print paper 4*a* is to be discharged through the other side of the printer 1, the print paper 4*a* is temporarily guided into the paper path 9*b*. Then, the switching blade 24 is shifted to the dotted position, thereby guiding the print paper 4*a* to the feed-out rollers 25*a* and 25*b* which in turn discharge the print paper 4*a*.

The cassette 5 is of the construction where the paper tray 10 is formed on one side of the partition 5*a* and the ink ribbon receiving sections 12*a* and 12*b* on the other side, and the curved paper paths 9*a* and 9*b* are formed laterally immediately beside the stacked assembly of the paper tray 10 and the ink ribbon receiving sections 12*a* and 12*b*. Thus, the print path is formed with a minimum of space. This construction lends itself to miniaturizing the printer.

Each of the outer wall surface of the cassette 5 which is detachably loaded to the printer 1 serves to form one of the opposed wall surfaces of the paper path 9*a* and 9*b*, thereby providing simple structure of the printer 1. This structure is advantageous in that if the print paper 4 is jammed in the paper path, the print paper 4 can easily be removed by unloading the cassette 5 from the printer 1.

Second embodiment

A second embodiment differs from the first embodiment in that a cassette 41 is used in place of the cassette 5.

Figure 4:
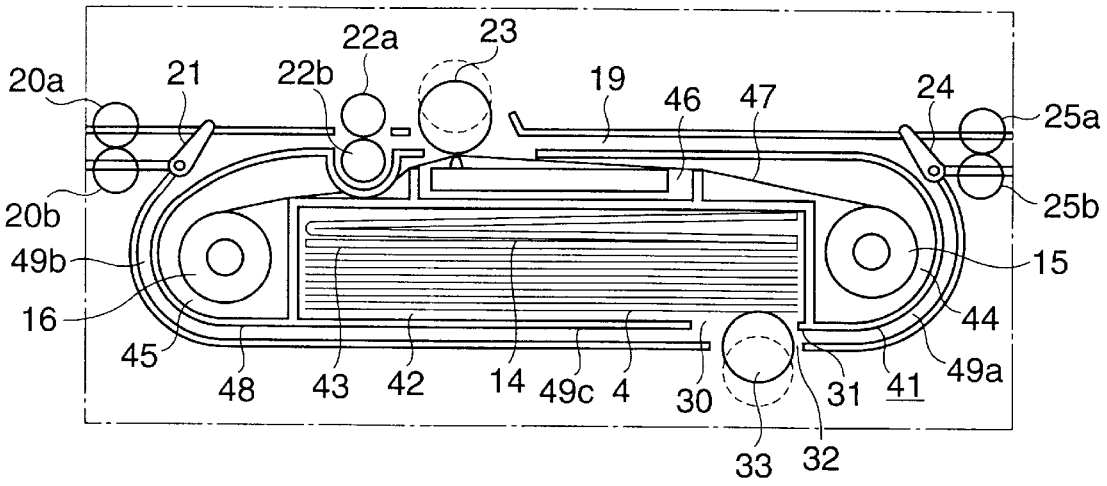
FIG. 4 illustrates a printer according to a second embodiment.

FIG. 4 illustrates a printer according to a second embodiment.

Referring to FIG. 4, the cassette 41 includes a paper tray 42 that accommodates the stack of print paper 4. The paper tray 42 is provided with a plate 43 and a flat spring 14 that urges the plate 43 against the stack of print paper 4. Since the plate 43 extends to cover the entire top area of the stack of print paper 4, the urging force of the flat spring 14 is substantially evenly distributed over the entire top area of the stack of the print paper. Ink ribbon receiving sections 44 and 45 are formed laterally on both sides of the paper tray 42, and accommodate a supply roller 15 and a take-up roller 16, respectively. A thermal head receiving section 46 is disposed over the paper tray 42 and accommodates the thermal head. An ink ribbon 47 extends across the supply roller 15 and the take-up roller 16, passing over the thermal head receiving section 46.

When the cassette 41 has been mounted to the printer 1, the outer surface 48 of the cassette 41 serves as one of the opposing walls that define the paper paths 49*a*–49*c* just as in the first embodiment. The paper paths 49*a* and 49*b* has as large a curvature as the print paper can comfortably be advanced through the paper paths 49*a* and 49*b*. The rest of the structure is the same as the first embodiment.

The lateral arrangement of the supply roller/take-up roller receiving sections 44 and 45 and the paper tray 42 implements overall thin construction of the cassette 41. Thus, in addition to the advantages of the first embodiment, the second embodiment implements the cassette 41 of thin construction which in turn lends itself to implementing the printer main body of thin construction.

Third embodiment

<Construction>

Figure 5:
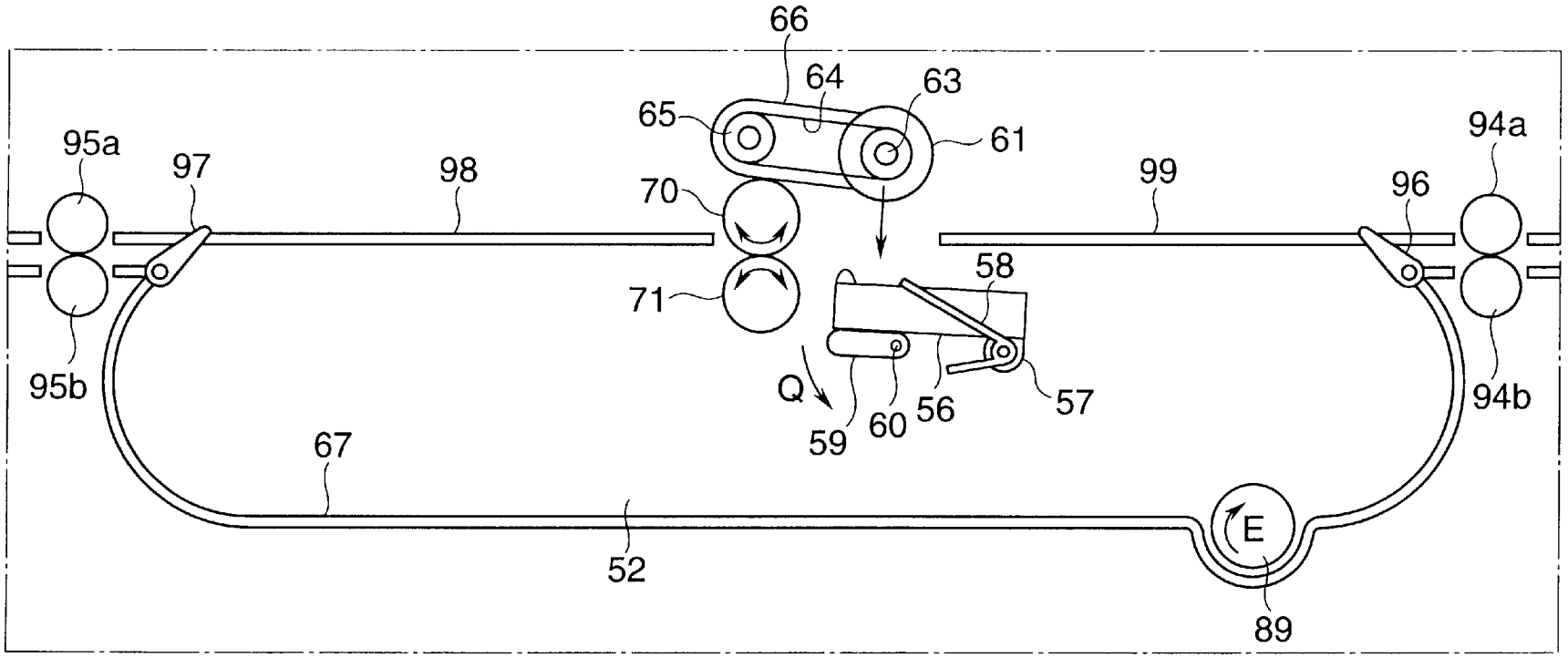
FIG. 5 illustrates a printer according to a third embodiment before a cassette has been mounted therein.

FIG. 5 illustrates the printer before a cassette has been mounted therein.

The third embodiment is of the construction where a feed roller 89 is not vertically movable.

(Cassette receiving section)

Referring to FIG. 5, the thermal printer 51 has a cassette receiving section 52 defined by a sidewall 67.

A cassette 55 is inserted into the cassette receiving section 52 in a direction perpendicular to FIG. 5.

The platen roller 61 is concentric with a pulley 63, which is driven in rotation through a belt 64 by a drive pulley 65. The shafts of the pulleys 63 and 65 are mounted to a support 66. When a printing operation is performed, the support 66 pivots clockwise bringing the platen roller 61 into pressure contact engagement with the thermal head 56, and the pulley 65 rotates clockwise. When a printing operation is not performed, the support 66 pivots counterclockwise bringing the platen roller 61 out of contact engagement with the thermal head 56.

The thermal head 56 is pivotally supported on a shaft 57 that projects in a manner similar to a "cantilever" toward the reader from the wall of the printer. A torsion spring 58 is mounted on the shaft 57 and urges the thermal head 56 to rotate counterclockwise. A cam 59 is provided below the thermal head 56 and is rotatable about a shaft 60 in a direction shown by arrow Q.

There are provided discharge rollers 94*a*–94*b* and 95*a*–95*b* and switching blades 96 and 97, which will be described later with reference to FIG. 8.

(Cassette)

Figure 6:
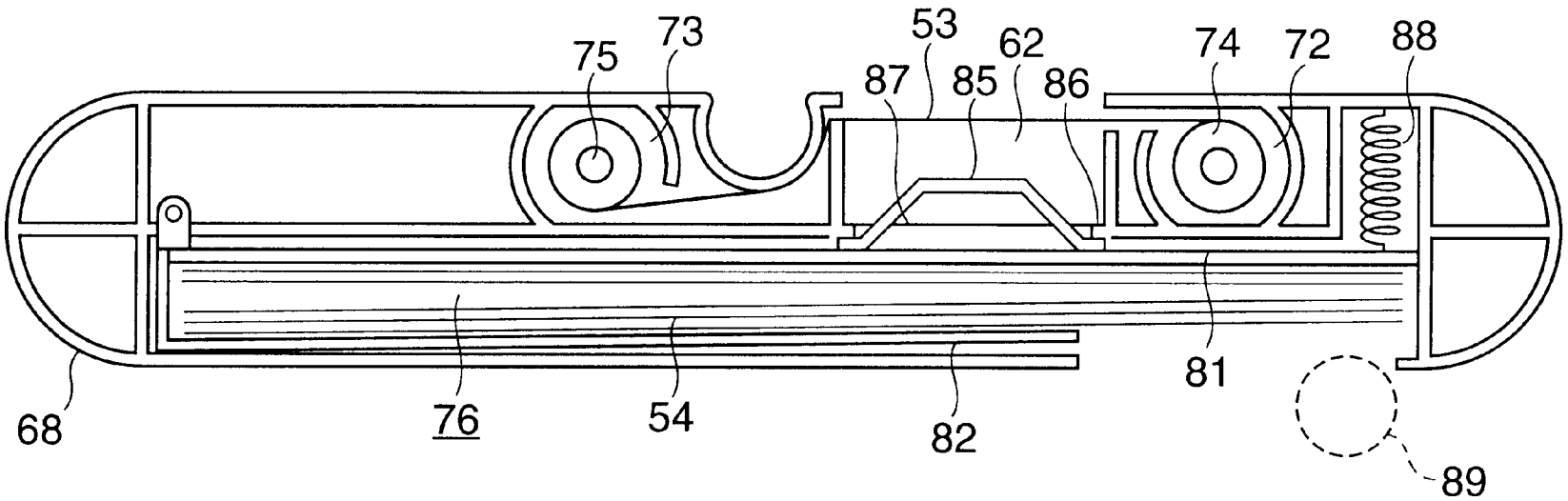
FIG. 6 illustrates a construction of the cassette according to the third embodiment.

FIG. 6 illustrates a construction of the cassette according to the third embodiment.

Referring to FIG. 6, the cassette 55 has ink ribbon receiving sections 72 and 73 with the thermal head receiving section 62 defined therebetween.

A paper tray 76 is formed below the ink ribbon receiving sections 72 and 73 and thermal head receiving section 62, and holds a stack of print paper 54 therein.

The thermal head receiving section 62 is wide enough so that most of commercially available thermal heads can be accommodated. The ink ribbon receiving section 72 accommodates a supply roller 74 and the ink ribbon receiving section 73 receives a take-up roller 75. An ink ribbon 53 is supplied from the supply roller 74 to the take-up roller 75. The ink ribbon passes over the thermal head 56.

(Paper holder)

Figure 7:
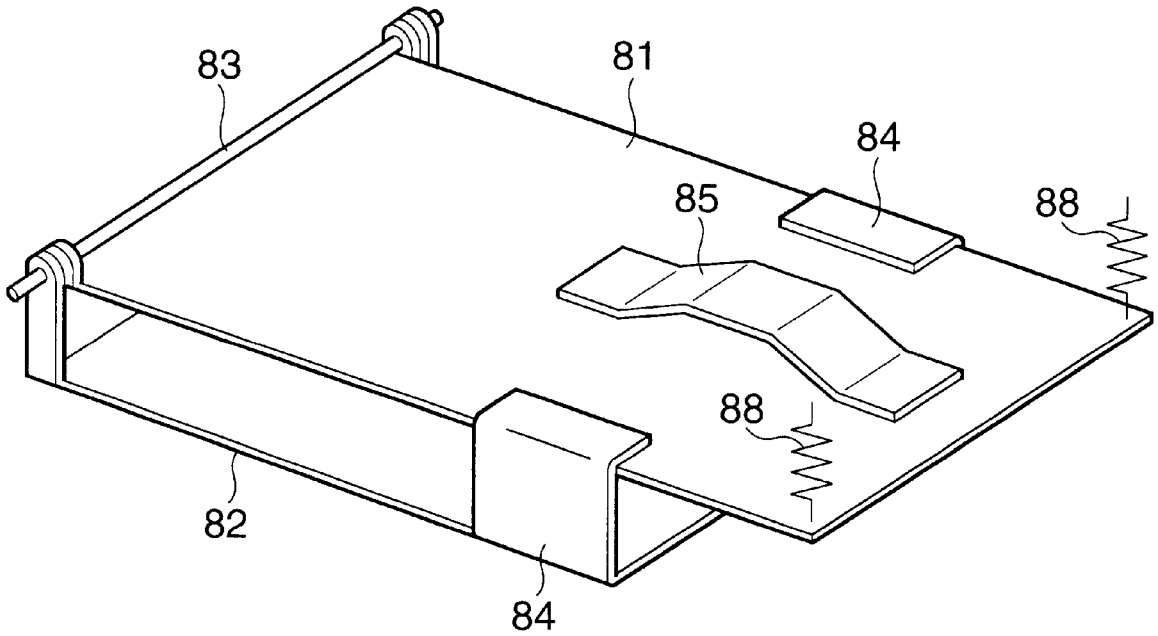
FIG. 7 is a perspective view of a paper holder provided in a paper tray of the third embodiment.

FIG. 7 is a perspective view of a paper holder 80 provided in the paper tray 76. The paper holder 80 includes an upper holder 81 and a lower holder 82. The upper and lower holders 81 and 82 are mounted on a shaft 83 and are rotatable about the shaft 83 independently of each other. The stack of print paper 54 is held between the upper and lower holders 81 and 82. The lower holder 82 is formed with L-shaped engagement portions 84 that engage the upper holder 81. When the upper holder 81 moves upward, the lower holder 82 also moves upward following the upper holder 81. As the remaining number of pages of print paper in the cassette decreases, the upper holder 81 gradually rotates clockwise (FIGS. 7 and 8) so that the bottom page of the stack of print paper 4 continues to be pressed against the feed roller 89.

A flat spring 85 is mounted on the upper surface of the upper holder 81. The flat spring 85 projects into the thermal head receiving section 62 through an opening 87 formed in a wall 86 that partitions the paper tray 76 and the thermal head receiving section 62. Once the cassette 55 has been mounted to the printer 51, the cam 59 is positioned over the flat spring 85. When the cam 59 is oriented vertically as shown in FIG. 8, the cam 59 pushes the flat spring 85 downward and the thermal head 56 upward.

The upper holder 81 has coil springs 88 mounted on its upper free end portion. The coil springs 88 pull the upper holder 81 upward. The downward urging force produced by the cam 59 and flat spring 85 is sufficiently larger than the upward urging force of the coil springs 88. When the cam 59 and flat spring 85 urges the upper holder 81 downward, the leading end portion of the bottom page of the stack of print paper 54 is brought into pressure contact with the feed roller 89.

(Overall construction)

Figure 8:
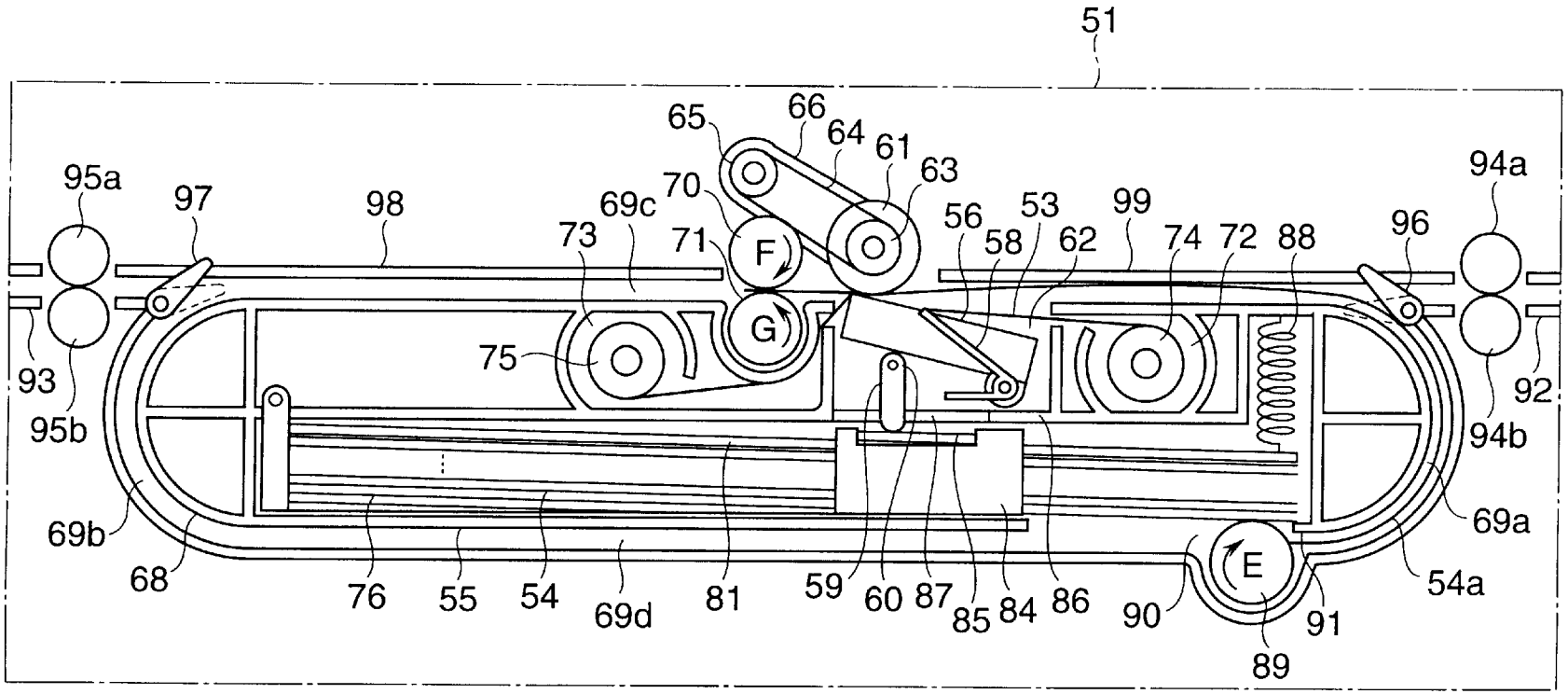
FIG. 8 illustrates a construction of the printer according to the third embodiment.

FIG. 8 illustrates a construction of a printer 51 according to the third embodiment.

Referring to FIG. 8, when the cassette 55 is mounted into the cassette receiving section 52 of the printer 1, paper paths 69*a*, 69*b*, 69*c*, and 69*d* are defined between the outer wall 68 of the cassette 55 and the sidewall 67 of the cassette receiving section 52. A paper path 69*c* is also defined between the upper outer surface of the cassette 55 and the walls 98 and 99. Feed rollers 70 and 71 are disposed in the paper path 69*c*.

When the cassette 55 has been loaded into the cassette receiving section 52, the thermal head 56 and cam 59 are received in a thermal head receiving section 62 of the cassette 55.

When the cam 59 rotates about the shaft 60 through approximately 90 degrees counterclockwise from the position shown in FIG. 5, the thermal head 56 is pushed up against the urging force of the torsion spring 58. As a result, the thermal head 56 comes into pressure contact with the platen roller 61 with the ink ribbon 53 and print paper 54 sandwiched between the thermal head 56 and the platen roller 61. The cam 59 ensures stable abutting of the thermal head 56 against the platen roller 61.

A paper feeding opening 90 is formed at a lower end of the cassette 55 so that the print paper 54 is advanced on a page-by-page basis from the cassette 55. A separator 91 ensures that only the bottom page of the stack of print paper 4 is directed into the paper path 69*a*. The switching blade 96 is at the solid line position. As opposed to the first embodiment, the feed roller 89 is not vertically movable but rotatable clockwise. Therefore, the third embodiment is simpler in the structure of the feed roller 89 and its surroundings than the first embodiment.

The length of the print paper 54 in the direction of travel of the print paper is little longer than the paper path that runs from the feed roller 89, through the curved paper path 69*a* and the paper path 69*c*, to the feed rollers 70 and 71. The distance from the beginning of the print region on the print paper 54 to the trailing end of the print paper 54 is shorter than the paper path that runs from the feed roller 89 through the curved paper path 69*a* to the feed rollers 70 and 71. The distance from the feed rollers 70 and 71, through the curved paper path 69*b* and straight paper path 69*d*, to the feed roller 89 is longer than the distance from the leading end of the print paper 54 to the end of print region on the print paper 54.

There are provided paper exits 92 and 93 on the opposite ends of the printer 51, and feed-out rollers 94*a*–94*b* and 95*a*–95*b* upstream of the paper exits 92 and 93, respectively. A switching blade 96 is disposed at a location where the paper path 69*d* branches into the curved paper path 69*a* and the paper exit 92. A switching blade 97 is disposed at a location where the paper path 69*d* branches into the curved paper path 69*b* and paper exit 93. The switching blades 96 and 97 pivot between their dotted line positions and the solid line positions, thereby switching the directions of the paper paths.

The printer 51 incorporates a drive mechanism that drives take-up roller 75 to take up the ink ribbon 53. The mechanism is similar to that of the first embodiment shown in FIG. 2. The ink ribbon 53 is a color ink ribbon designed for color printing, i.e., the ink ribbon 53 has a plurality of regions of colored ink with substantially the same width as the print paper 54.

(Controller)

Figure 9:
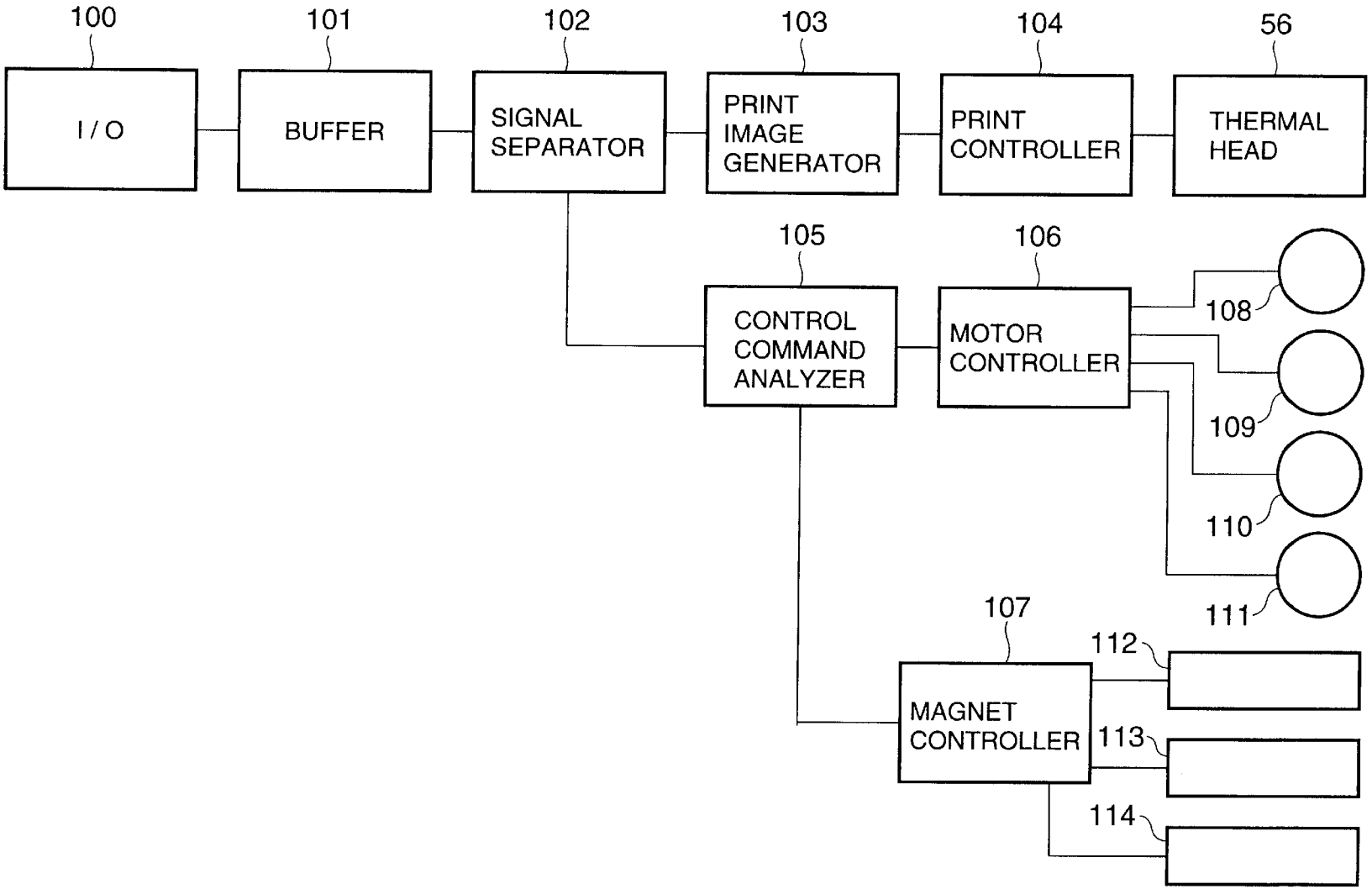
FIG. 9 is a block diagram illustrating the control of the printer according to the third embodiment.

FIG. 9 is a block diagram illustrating the control of the printer according to the third embodiment.

Referring to FIG. 9, an interface 100 receives print data and control commands from an external apparatus. A buffer 101 stores the received data, etc. A signal separator 102 separates the received signals into control signals and image data. An image data generator 103 generates image data from the received print data. A print controller 104 controls the thermal head 56. A control command analyzer 105 analyzes the received control commands. A motor controller 106 controls various motors 108–111 in accordance with the control commands received from the control command analyzer 105. A magnet controller 107 controls plunger magnets 112, 113 and 114 in accordance with the control commands.

The motor controller 106 is connected to motors 108–111. The motor 108 drives the feed roller 89 in rotation. The motor 109 drives the platen roller 61 and feed rollers 70 and 71 in rotation. The motor 110 drives the take-up roller 75 for the ink ribbon 53 in rotation. The motor 111 drives the feed-out rollers 94*a*–94*b* and 95*a*–95*b* in rotation. The magnet controller 107 is connected to plunger magnets 112 and 113 that drive the switching blades 96 and 97, respectively, and to plunger magnet 114 that drives the support 66.

<Operation>

(General operation)

The operation of the third embodiment will be described.

FIG. 6 shows the cassette 54 before it is loaded into the printer.

(Initial set-up)

Referring to FIG. 6, the upper holder 81 is lifted by the coil springs 88. The flat spring 85 on the upper holder 81 projects through the opening 87 into the thermal head receiving section 62. Thus, since the upper holder 81 is lifted, the lower holder 82 is also lifted. Therefore, the stack of print paper 54 is also lifted so that the bottom page of the stack of print paper 54 moves out of engagement with the feed roller 89.

Before the cassette 55 is loaded into the printer 51, the platen roller 61, thermal head 56, and cam 59 are at the positions shown in FIG. 5 and the rotational shafts 57 and 60 are supported at one ends thereof in a "cantilever fashion." The cassette 55 is then attached to the printer 51. When the cassette 55 has been attached, the thermal head 56 and cam 59 are received in the thermal head receiving section 62 and the shafts 57 and 60 are supported at the other ends thereof by a supporting means provided on the cassette side, not shown, so that the shafts 57 and 60 are firmly held at both ends. This ensures stable holding of the thermal head 56 and cam 59.

Then, the cam 59 is rotated through an angle of substantially 90 degrees counterclockwise from the position shown in FIG. 5 to the position shown in FIG. 8. The cam 59 may be rotated manually or automatically rotated by a drive means, not shown. The rotation of the cam 59 causes the upper holder 81 to descend against the urging force of the coil springs 88, so that the bottom page of the stack of print paper 54 comes into pressure contact with the feeding roller 89. The rotation of the cam 59 also causes the thermal head 56 to move upward till the tip of the thermal head 56 is at the position shown in FIG. 8.

After the cassette 55 has been attached to the printer 51, the gear on the shaft of the take-up roller 75 meshes with the gear on the printer 51 side so that the take-up roller 75 can be driven in rotation by the motor 110. The switching blade 97 is at the solid line position shown in FIG. 8. Thus, the printer 51 becomes ready to print.

(Printing)

Upon receiving the control signals and print data from an external apparatus, the interface 100 stores the control signals and print data in the buffer 101 temporarily. The signal separator 102 separates the received signals into control signals and print data. The control command analyzer 105 analyzes the control signals and separates the received control signals into control signals for driving the motors and control signals for driving the plunger magnets. The control command analyzer 105 sends to the motor controller 106 the control signals that drives the motors.

The feed motor 108 is driven in rotation, so that the feed roller 89 rotates in a direction shown by arrow E (FIGS. 5 and 8). As a result, the bottom page 54*a* of the stack of print paper 54 is advanced into the paper path 69*a*. The separator 91 ensures that the bottom page 54*a* is separated from the stack and fed into the paper path 69*a*. At this moment, the switching blade 96 is at the solid line position in FIG. 8. The motor controller 106 causes the motor 109 to rotate, thereby rotating the platen roller 61 clockwise and rotating the feed rollers 70 and 71 in directions shown by arrows F and G.

The print paper 54*a* passes through the curved paper path 69*a* into the upper paper path 69*c*. Then, the print paper 54*a* passes between the platen roller 61 and the ink ribbon 53. When the print paper is pulled in between the feed rollers 70 and 71 and advanced slightly forward, the trailing end of the print paper 54*a* moves out of engagement with the feed roller 89. When the print paper 54*a* has advanced slightly between the feed rollers 70 and 71, a paper sensor, not shown, detects the print paper 54*a* and generates a signal that causes the feed rollers 70 and 71 to stop. Then, the magnet controller 107 causes the plunger magnet 114 to drive the support 66, thereby moving the platen roller 61 from the position shown in FIG. 5 to the position shown in FIG. 8. The platen roller 61 and feed rollers 70 and 71 begin to again rotate to start the printing.

The print image generator 103 translates the print data, which has been separated by the signal separator 102, into bit map data that can be directly printed on the print paper. The bit map data is sent to the print controller 104. When the printing begins, the print controller 104 sends the bit map data to the thermal head 56. The thermal head 56 is driven to generate heat in accordance with the bit map data supplied thereto, while the feed rollers 70 and 71 advance the print paper 54*a* forwardly. The generated heat is applied to the colored ink of the ink ribbon 53 so that the colored ink is transferred to the print paper 54*a*. As described above, the switching blade 97 is at the solid line position shown in FIG. 8. As the printing proceeds, the leading end of the print paper 54*a* is guided into the paper path 69*b* and then the lower print path 69*d*.

When the print data of a corresponding color for one page has been printed, the direction of rotation of the motor 109 is reversed so that the feed rollers 70 and 71 are rotated in their reverse directions and the platen roller 61 is moved away from the print paper 54*a*. The print paper 54*a* is then transported rearward, so that the trailing end of the print paper 54*a* enters the curved paper path 69*a*. When the print paper 54*a* has been moved rearward till the beginning of the print region on the print paper 54*a* reaches the thermal head 56, the feed rollers 70 and 71 stop their reverse rotations. At this moment, the trailing end of the print paper 54*a* has not reached the feed roller 89.

Then, the printing of the second color begins. Just as in the printing of the first color, platen roller 61 presses the print paper 54*a* against the thermal head 56. The feed rollers 70 and 71 are rotated in the forward directions. The thermal head 56 generates heat in accordance with the bit map data. As the printing proceeds, the leading end of the print paper 54*a* enters the curved print path 69*b*.

The foregoing steps are repeated as many times as there are colors of inks. Then, immediately before the printing of the final page, the plunger magnet 113 shifts the switching blade 97 to the dotted line position, so that the print paper 54*a* that has been printed is discharged by the feed-out rollers 95*a* and 95*b*. If the print paper 54*a* is to be discharged from the other side of the printer 51, the printed paper 54*a* is once guided into the curved paper path 69*b* and thereafter the plunger magnet 112 shifts the switching blade 96 to the dotted line position. Then, the print paper 54*a* is transported rearward so that the print paper 54*a* is discharged by the feed-out rollers 94*a* and 94*b*.

The aforementioned embodiments have been described with respect to printers for color printing, the present invention is also applicable to printers for monochrome printing. For monochrome printers, the paper path only need to be provided from the opening through which the print paper is fed from the paper tray, to the thermal head. Thus, the monochrome printer can be of simplified construction.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An ink ribbon-print paper cassette for use in a thermal printer, the cassette comprising:

a paper tray that accommodates a stack of single sheets of print paper, the paper-tray having an opening through which the print paper is fed into a paper path on a sheet-by-sheet basis;

a thermal head receiving section located adjacent said paper tray and on a side of said paper tray remote from the opening;

an ink ribbon for thermal printing that runs over said thermal head receiving section;

a housing that accommodates said paper tray, thermal head receiving section, and ink ribbon, said housing having an outer surface;

wherein when said cassette is loaded into the thermal printer, said outer surface and an inner wall of the thermal printer form a paper path therebetween through which each of the sheets of print paper is advanced from said paper tray to said thermal head receiving section.

2. The ink ribbon-print paper cassette according to claim 1, wherein said ink ribbon is unreeled from a supply roller to a take-up roller, said supply roller and take-up roller being disposed with said thermal head receiving section therebetween.

3. The ink ribbon-print paper cassette according to claim 1, wherein said ink ribbon is unreeled from a supply roller to a take-up roller, said supply roller and take-up roller being disposed with said paper tray therebetween.

4. The ink ribbon-print paper cassette according to claim 1, wherein outer surface of said housing and the inner wall of the thermal printer have curved portions such that the paper path run all around said housing.

5. The ink ribbon-print paper cassette according to claim 1, wherein said paper tray includes a holder that holds the stack of single sheets of print paper such that the stack of sheets of print paper is movable relative to the opening.

6. A thermal printer having a cassette receiving section into which an ink ribbon-print paper cassette is loaded, wherein said cassette receiving section comprising:

a thermal head; and an inner wall;

wherein said cassette comprising:

a paper tray that accommodates a stack of single sheets of print paper, said paper tray having an opening through which the print paper is advanced from said paper tray on a sheet-by-sheet basis;

an ink ribbon for thermal printing;

a housing having an outer surface, and accommodating said paper tray, said ink ribbon, and a thermal head receiving section located adjacent said paper tray and on a side of said paper tray remote from the opening;

wherein when said cassette is loaded into said cassette receiving section, said thermal head is received in said thermal head receiving section, said ink ribbon runs over the thermal head and the outer surface of the housing and the inner wall of the cassette receiving section form the paper path therebetween through which each of the sheets of print paper is transported during printing.

7. The thermal printer according to claim 6, further comprising:

a feed roller that feeds the print paper from said paper tray through said opening on a sheet-by-sheet basis;

wherein said cassette comprising;

a first urging member that urges the stack of print paper against said feed roller, said first urging member being selectively activated and deactivated; and a second urging member that urges the stack of print paper away from said feed roller;

wherein when said first urging member is activated, an urging force of said first urging member overcomes an urging force of said second urging member so that the stack of print paper is urged against said feed roller.

8. The thermal printer according to claim 7, further comprising a cam that is selectively positioned at a first position and a second position;

wherein the first urging member is a spring;

wherein said cam engages the spring to urge the stack of print paper against the feed roller when the cam is at the first position, and disengaging from the spring not to urge the stack of print paper against the feed roller when the cam is at the second position.

9. The thermal printer according to claim 8, wherein the first urging member urges the stack of print paper downward against the feed roller.

10. The thermal printer according to claim 6, wherein said ink ribbon includes a plurality of colored ink, and said thermal head prints a color image on the print paper.

11. The thermal printer according to claim 6, further comprising paper transporting members provided in the paper path;

wherein the paper path runs substantially all around said housing and includes a first path that runs from the opening through said thermal head to the paper transporting members, and a second path that is continuous with the first path and runs from paper transporting members back to the opening.

12. The thermal printer according to claim 11, wherein said first path is shorter than a length of the print paper in a direction of travel thereof, and said second path is longer than the length of the print paper in the direction of travel thereof.

13. The thermal printer according to claim 11, wherein said ink ribbon includes a plurality of colored ink, and said thermal head prints a color image on the print paper;

wherein the paper transporting members transport the print paper back and forth relative to said thermal head through said paper path while said thermal head prints the color image on the print paper.

* * * * *